US007726252B2

(12) United States Patent
Trobaugh, III

(10) Patent No.: US 7,726,252 B2
(45) Date of Patent: Jun. 1, 2010

(54) SYSTEMS AND METHODS FOR EDGE MEASUREMENT

(75) Inventor: Robert A. Trobaugh, III, Hampton Cove, AL (US)

(73) Assignee: Maples Industries, Inc, Scottsboro, AL (US)

( * ) Notice: Subject to any disclaimer, the term of this patent is extended or adjusted under 35 U.S.C. 154(b) by 790 days.

(21) Appl. No.: 11/670,438

(22) Filed: Feb. 2, 2007

(65) Prior Publication Data

US 2008/0184921 A1 Aug. 7, 2008

(51) Int. Cl.
*D05B 35/10* (2006.01)
*B65H 23/00* (2006.01)

(52) U.S. Cl. ..... 112/475.03; 112/153; 112/306; 700/136; 271/227

(58) Field of Classification Search ..... 112/306, 112/153, 314, 320, 475.01, 475.03, 475.04, 112/470.29; 700/130, 134, 136, 143; 38/143; 271/226, 227, 252, 255, 265.03, 228; 33/1 M, 33/1 BB, 1 CC, 2 R, 11
See application file for complete search history.

(56) References Cited

U.S. PATENT DOCUMENTS 5,035,415 A * 7/1991 Lee et al. ..... 271/265.03
5,416,992 A * 5/1995 Ueda et al. ..... 38/143
5,437,238 A * 8/1995 Price et al. ..... 112/470.29
5,619,942 A 4/1997 Stewart et al.
5,685,248 A 11/1997 Stewart et al.
5,928,462 A 7/1999 Stewart et al.
5,941,187 A * 8/1999 Rouleau et al. ..... 112/475.03
6,136,120 A 10/2000 Stewart et al.
6,260,495 B1 7/2001 Stewart et al.
6,533,267 B1 * 3/2003 Muessig et al. ..... 271/228
2003/0042670 A1 * 3/2003 Sahlmann ..... 271/226
2005/0028410 A1 * 2/2005 McCabe ..... 38/143
2006/0038340 A1 * 2/2006 Schinzel-Reiner et al. .. 271/226
2008/0237975 A1 * 10/2008 de Jong et al. ..... 271/226

* cited by examiner

*Primary Examiner*—Ismael Izaguirre
(74) *Attorney, Agent, or Firm*—Sutherland Asbill & Brennan, LLP

(57) ABSTRACT

A method for straightening the edges of a work piece. The method includes the steps of determining the average edge position of each edge of the work piece, calculating an average edge line for each edge of the work piece, determining an actual corner point for each corner of the work piece, calculating a determined edge line through each of the actual corner points of the work piece, determining a number of actual edge points, determining if actual edge points are within the determined edge lines, and adjusting the determined edge lines inward until the actual edge points are within the determined edge lines.

19 Claims, 5 Drawing Sheets

(EXAGGERATED)

SYSTEMS AND METHODS FOR EDGE MEASUREMENT

TECHNICAL FIELD

The present application relates generally to systems and methods for work piece edge detection and measurement and more particularly relates to systems and methods for finishing the edges of a textile or carpeting work piece in an accurate and efficient manner.

BACKGROUND OF THE INVENTION

Although numerous attempts have been made to automate the finishing process for textiles, carpeting, and similar materials, these attempts have not always been successful with respect to quality control and/or with respect to production time because of the general lack of uniformity in the work piece. For example, rugs may be cut by various means and have all types of variances therein. The width, length, and angles of the corners all may vary from piece to piece. The edges themselves may be cut with a bow or a crooked wave therein. Known automated systems that only accommodate the general length and the width of the work piece may not be able to accommodate these variations. The result thus may be an inefficient cutting at best or a damaged or rejected work piece.

There is a desire therefore for systems and methods for accommodating non-uniform work pieces in an automated finishing system. The systems and methods should be able to adapt to even minor variations in the work piece in a high speed and efficient manner.

SUMMARY OF THE INVENTION

The present application thus describes a method for straightening the edges of a work piece. The method may include determining the average edge position of each edge of the work piece, calculating an average edge line for each edge of the work piece, determining an actual corner point for each corner of the work piece, determining a number of actual edge points, calculating a determined edge line through each of the actual corner points of the work piece, determining if the number of actual edge points are within the determined edge lines, and adjusting the determined edge lines inward until the number of actual edge points are within the determined edge lines.

The method further may include taking an image of the work piece and evaluating that image with a blob tool. The method further may include determining an outline of the image of the work piece.

The step of determining the average edge position of each edge of the work piece may include evaluating the image of the work piece with edge detection tools. The step of determining an actual corner point for each corner of the work piece may include evaluating the image of the work piece with edge detection tools. The step of determining a number of actual edge points may include evaluating the image of the work piece with edge detection tools.

The method further may include the step of adjusting the determined edge lines inward. The adjusting step is repeated until the number of actual edge points is within the determined edge lines and a number of final edge lines are calculated. The method further may include the step of routing the final edge lines to a maneuvering system. The final edge lines may include the final angles. The work piece then may be finished according to the number of final edge lines.

The present application further describes a finishing system for a work piece. The finishing system may include a sewing head, a visual sensor for taking an image of the work piece, and a number of edge positioning tools for determining an actual corner point for each corner of the work piece and for determining a number of actual edge points for each edge of the work piece. The system further includes calculating means to determine a number of determined edge lines through the actual corner points and to determine if any of the number of actual edge points are outside the number of determined edge lines so as to create a number of final edge lines outside of the number of actual edge points. The system also includes a maneuvering system for maneuvering the work piece through the sewing head such that the work piece is finished along the number of final edge lines.

The maneuvering system may include a gantry arm assembly with a template. The visual sensor may include a blob tool. The number of final edge lines may include an equilateral shape.

The present application further describes a method for straightening the edges of a work piece. The method may include determining an actual corner point for each corner of the work piece, determining a number of actual edge points, calculating a determined edge line through each of the actual corner points of the work piece, determining if the number of actual edge points are within the determined edge lines, and adjusting the determined edge lines inward until the number of actual edge points are within the determined edge lines. The adjusting step is repeated until the number of actual edge points is within the determined edge lines and a number of final edge lines are calculated.

These and other features of the present application will become apparent to one of ordinary skill in the art upon review of the following detailed description when taken in conjunction with the several drawings and the appended claims.

DETAILED DESCRIPTION

Figure 1:
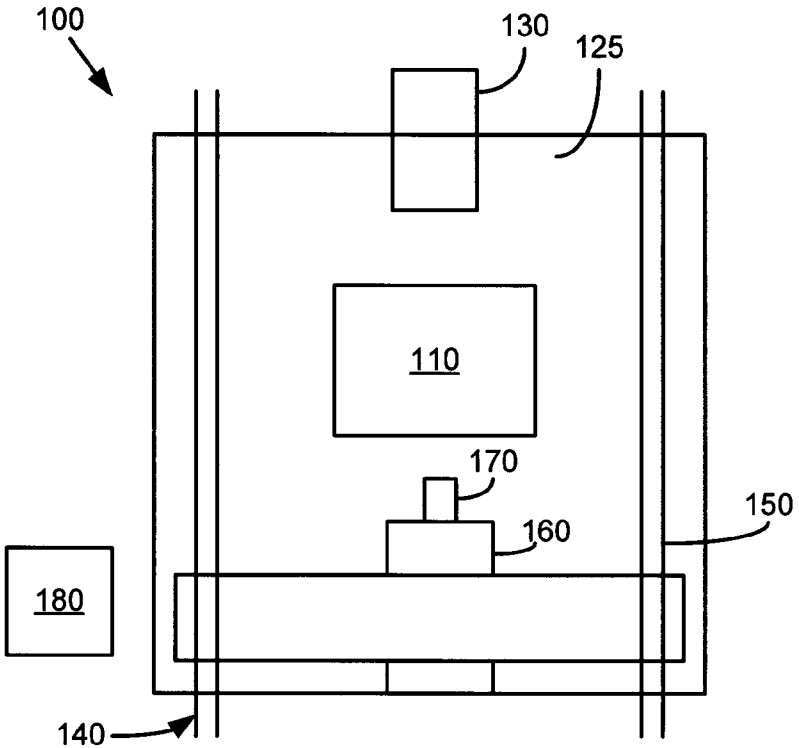
FIG. 1 is a schematic view of a finishing apparatus as is described herein.

Referring now to the drawings in which like numerals refer to like elements throughout the several views, FIG. 1 shows a schematic view of a finishing system 100. The finishing system 100 is used to finish the edges of a work piece 110 in a conventional manner. The work piece 110 may be any type of textile, carpeting, or similar type of woven product of any shape or dimension. The work piece 110 may be cut from a continuous source of material. Each work piece 110 has a number of corners 115 and edges 120. The finishing system 100 includes a tabletop 125. The tabletop 125 may be any type of substantially flat surface of any dimension. The work piece 110 is maneuvered along the tabletop 125.

Mounted on the tabletop 125 may be a sewing head 130. The sewing head 130 may be of conventional design. For example, sewing heads made by Pegasus of Singapore and sold under the designations EX5204-24 and EX5203-25. Other examples include sewing heads sold by Union Special of Huntley, Ill. under the designation "Model 56300G". JUKI Corporation of Tokyo, Japan also sells a flat bed sewing head. Similar types of devices may be used herein. More than one sewing head 130 may be used. Further, more than one type of sewing head 130 also may be used for versatility in accommodating different types of work pieces 110.

The finishing system 100 further includes a maneuvering system 140. The maneuvering system 140 may be of conventional design. The maneuvering system 140 may be any type of device that can maneuver the work piece 110 across the tabletop 125 or otherwise. In this example, the maneuvering system 140 may take the form of a gantry arm assembly 150 with a template 160 or similar types of device. The gantry arm assembly 150 allows the template 160 to move in the X and Y directions. Likewise, the template 160 may maneuver in the Z direction as desired. An example of a maneuvering system 140 is shown in U.S. Pat. No. 5,619,942, entitled "Method And Apparatus For Finishing The Edges Of A Textile Product." U.S. Pat. No. 5,619,942 is incorporated herein by reference.

The finishing system 100 further may include a number of visual sensors 170. The visual sensors 170 may be mounted on the maneuvering system 140 or they may be free standing. The visual sensors 170 may take the form of cameras, photo optical devices, Examples include sensors sold by Cognex Corporation of Natick, Mass. under the designations of "Model 5000" and "DVT". Similar types of devices may be used herein. More than one type of visual sensor 170 may be used A programmable controller 180 may control operation of the components of the finishing system 100 as a whole. The controller 180 may be a conventional microprocessor or a similar type of programmable device. For example, a PMAC controller sold by Delta Tau Data Systems of Hayward, Calif. and similar types of devices may be used herein.

It is important to note that the finishing system 100 described above is by way of example only. The edge detection techniques described below can be used with many different types of finishing systems such that the scope of the invention is in no way limited to the use of the finishing system 100 described herein.

Figure 2:
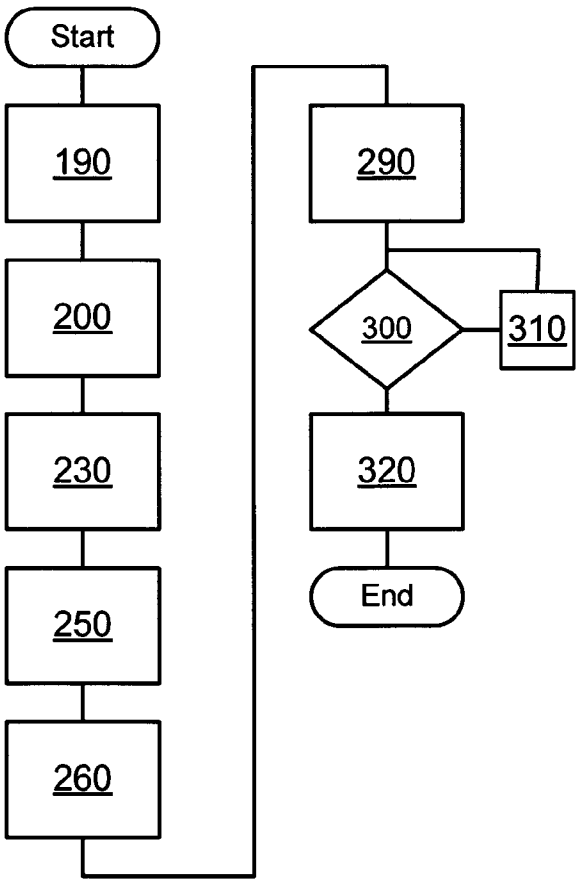
FIG. 2 is a flowchart showing the finishing methods as are described herein.

FIG. 2 is a flowchart showing the various steps in the edge positioning methods described herein. The steps of the flowchart relate to programming steps that can be embodied in conventional software code by one of ordinary skill in the art, i.e., these steps may be embodied in a computer-readable medium having computer-executable instructions in any conventional programming language.

Figure 3:
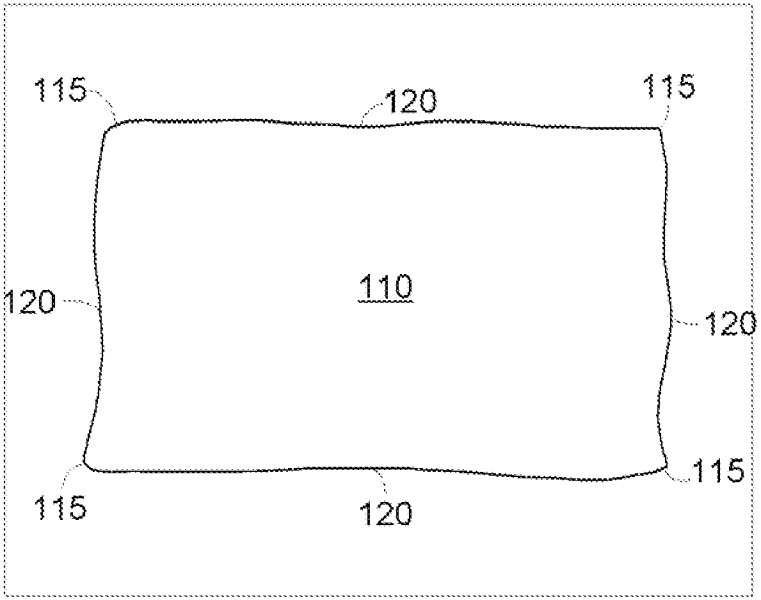
FIG. 3 is a plan view of a work piece as seen by the system described herein.

FIG. 3 shows the first step, a rough outline step 190. Specifically, the visual sensor 170 determines the outline of the work piece 110. The visual sensor 170 may take a picture of the work piece 110. That picture then may be evaluated by a blob tool so as to define the edges of the work piece. A blob tool detects changes in pixels such that a general outline of an object in a region of interest may be determined. Blob tool software is available, by way of example, through Cognex Corporation of Natick, Mass. Other types of visual interpretation software and means may be used herein.

Figure 4:
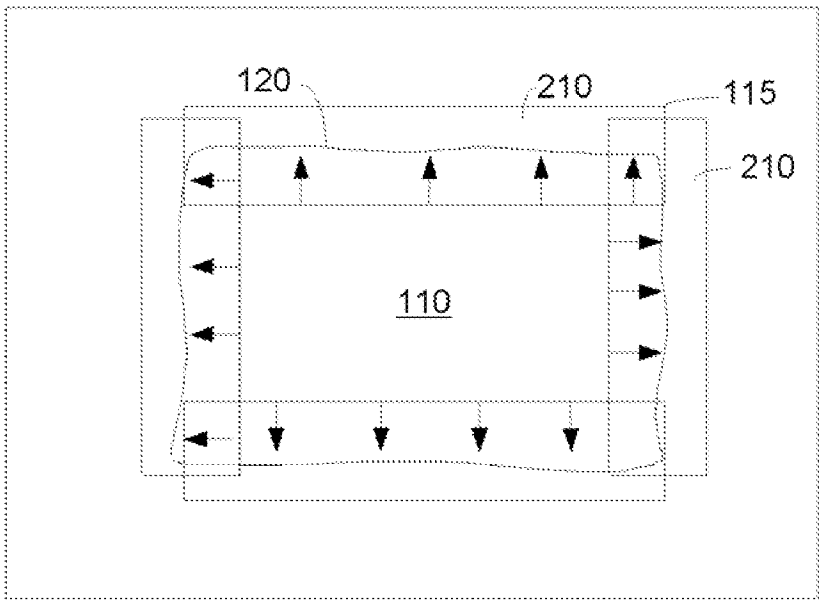
FIG. 4 shows the use of edge detection tools with the work piece to determine the average edge position.
Figure 5:
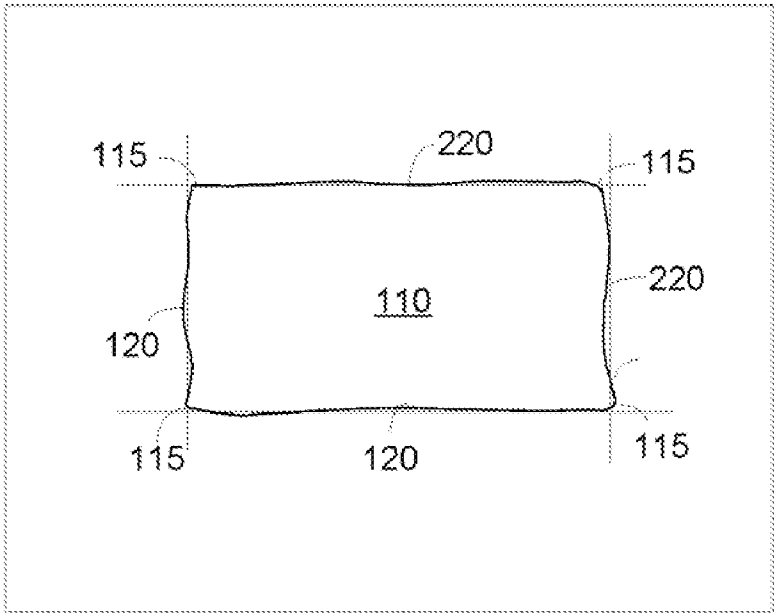
FIG. 5 shows the average edge line for each edge of the work piece.

The next step is an edge detection step 200. As is shown in FIG. 4, edge detection tools 210 are applied to the general outline produced by the measurements of the blob tool. The edge detection tools 210 determine the average position of each edge 120 so as to calculate an average edge line 220 for each edge. The edge detection 210 tools are part of the blob tool software packages described above. Other types of visual interpretation software and means may be used herein. The overlap in the average edge lines 220 is used in an intersection calculation step 230. The intersection of the average edge lines 220 thus is calculated and determined as is shown in FIG. 5.

Figure 6:
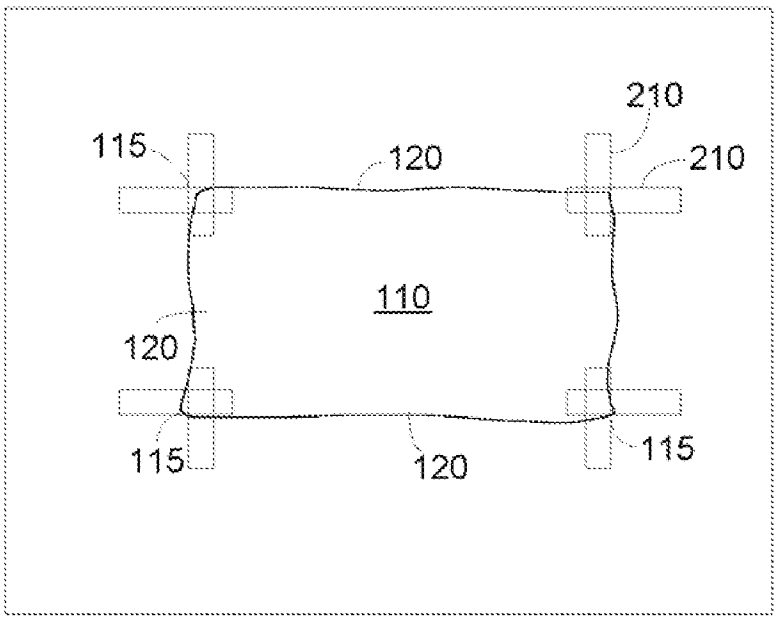
FIG. 6 shows the use of edge detection tools to determine the actual location of the corner points.

A number of actual corner points 240 are then found in an actual corner detection step 250 shows in FIG. 6. As is shown, the edge detection tools 210 are placed at the image of each corner to find the actual location of each actual corner point 240.

Figure 8:
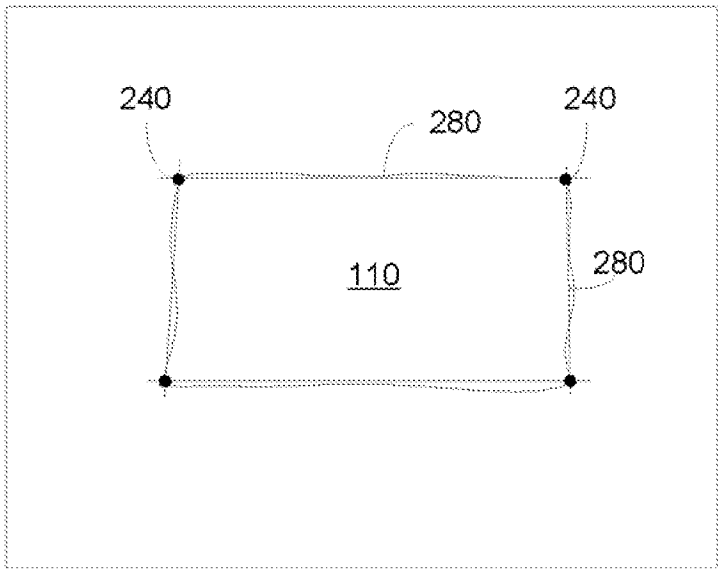
FIG. 8 shows the calculation of each true corner point.
Figure 7:
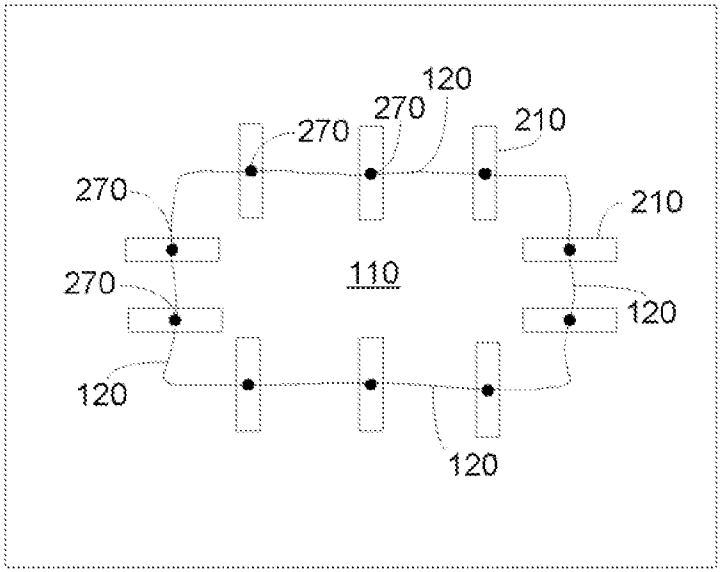
FIG. 7 shows the determination of actual edge points of the edges of the work piece with edge detection tools.

The next step is an actual edge detection step 260. As is shown in FIG. 7, edge detection tools 210 are placed along the sides of the image of the work piece 110 so as to locate a number of actual edge points 270 along the respective edges. The actual edge points 270 generally include minimum and maximum point locations along the edges. Based upon this determination, a determined edge line 280 through each of the actual corner points 240 is found in step 290 and shown in FIG. 8.

Figure 9:
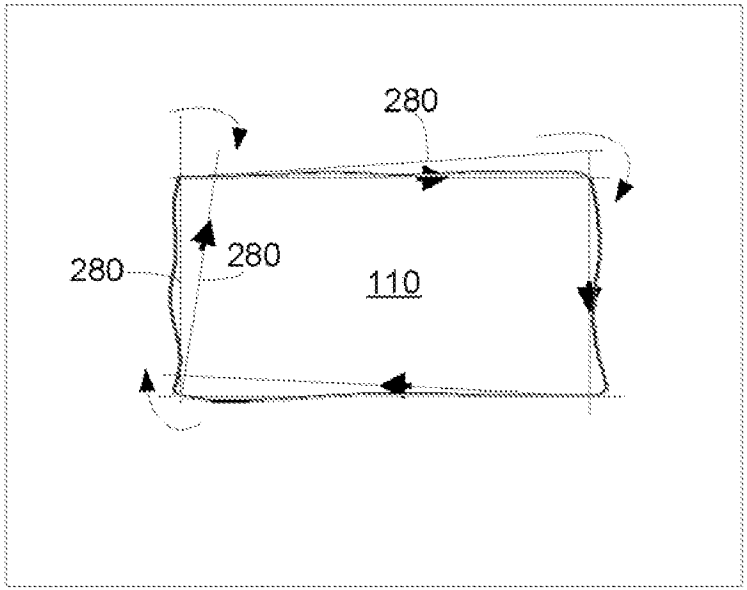
FIG. 9 shows the adjustments in the determined edge lines to accommodate the actual edge points (exaggerated).

The next step is an evaluation step 300. The actual edge points 270 are evaluated to determine if any are outside of the determined edge lines 280. If so, the determined edge lines 280 are adjusted inward at step 310 as is shown in exaggerated form in FIG. 9. The start of the edge at the actual corner point 240 remains fixed. The determined edge lines 280 are adjusted until all of the actual edge points 270 are within the determined edge lines 280 and a final shape is produced.

Figure 10:
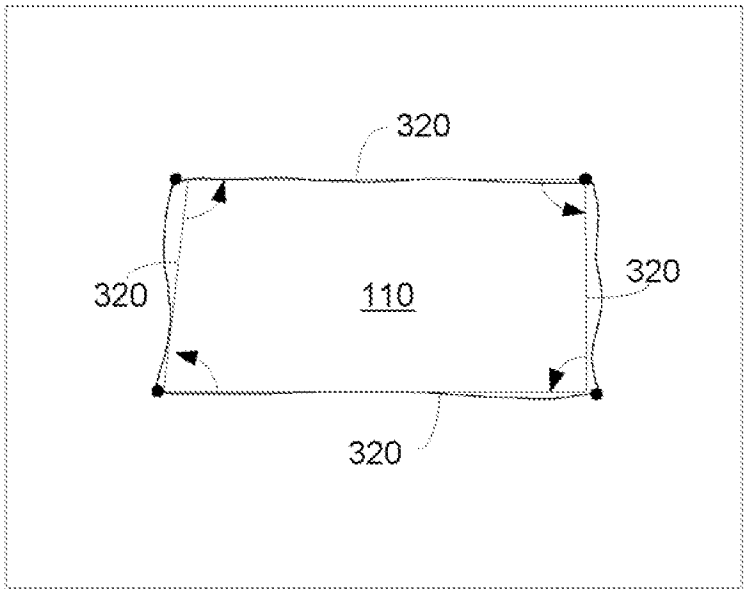
FIG. 10 shows the final work piece.

Once all of the actual edge points 270 are within the adjusted determined edge line 280, a number of final edge lines 320 are calculated. These final edge lines 320, including length and angle, are sent to the maneuvering system 140 in a routing step 330. As is shown in FIG. 10, the result is a work piece outline with four edge lines that are guaranteed to be within the work piece 110. These coordinates are then sent to the controller 180 along with the width, location, and angle for the finishing system 100 to use to move the work piece 110 along the tabletop 125 and the sewing head 130.

The systems and methods described herein thus produce a finished work piece 110 with uniform sides regardless of any imperfections in the original piece. Further, the system and methods described herein optimize the sewing paths such that the sewing is always on the edge of the work piece 110.

It should be apparent that the foregoing relates only to the preferred embodiments of the present application and that numerous changes and modifications may be made herein by one of ordinary skill in the art without departing from the general spirit and scope of the invention as defined by the following claims and equivalents thereof.

I claim:

1. A method for straightening the edges of a work piece, comprising:

determining the average edge position of each edge of the work piece;

calculating an average edge line for each edge of the work piece;

determining an actual corner point for each corner of the work piece;

determining a plurality of actual edge points;

calculating a determined edge line through each of the actual corner points of the work piece;

determining if the plurality of actual edge points are within the determined edge lines; and adjusting the determined edge lines inward until the plurality of actual edge points are within the determined edge lines.

2. The method of claim 1, further comprising taking an image of the work piece.

3. The method of claim 2, further comprising evaluating that image with a blob tool.

4. The method of claim 2, further comprising determining an outline of the image of the work piece.

5. The method of claim 2, wherein the step of determining the average edge position of each edge of the work piece comprises evaluating the image of the work piece with edge detection tools.

6. The method of claim 2, wherein the step of determining an actual corner point for each corner of the work piece comprises evaluating the image of the work piece with edge detection tools.

7. The method of claim 2, wherein the step of determining a plurality of actual edge points comprises evaluating the image of the work piece with edge detection tools.

8. The method of claim 2, further comprising the step of adjusting the determined edge lines inward.

9. The method of claim 1, wherein the adjusting step is repeated until the plurality of actual edge points are within the determined edge lines and a plurality of final edge lines are calculated.

10. The method of claim 9, further comprising the step of routing the final edge lines to a maneuvering system.

11. The method of claim 9, wherein the calculating the final edge lines comprises calculating the final angles.

12. The method of claim 10, further comprising finishing the work piece according to the plurality of final edge lines.

13. A finishing system for a work piece, comprising:

a sewing head;

a visual sensor for taking an image of the work piece;

a plurality of edge positioning tools for determining an actual corner point for each corner of the work piece and for determining a plurality of actual edge points for each edge of the work piece;

calculating means to determine a plurality of determined edge lines through the actual corner points and to determine if any of the plurality of actual edge points are outside the plurality of determined edge lines so as to create a plurality of final edge lines outside of the plurality of actual edge points; and a maneuvering system for maneuvering the work piece through the sewing head such that the work piece is finished along the plurality of final edge lines.

14. The finishing system of claim 13, wherein the maneuvering system comprises a gantry arm assembly.

15. The finishing system of claim 13, wherein the gantry arm assembly comprises a template.

16. The finishing system of claim 13, wherein the visual sensor comprises a blob tool.

17. The finishing system of claim 13, wherein the plurality of final edge lines comprise an equilateral shape.

18. A method for straightening the edges of a work piece, comprising:

determining an actual corner point for each corner of the work piece;

determining a plurality of actual edge points;

calculating a determined edge line through each of the actual corner points of the work piece;

determining if the plurality of actual edge points are within the determined edge lines; and adjusting the determined edge lines inward until the plurality of actual edge points are within the determined edge lines.

19. The method of claim 18, wherein the adjusting step is repeated until the plurality of actual edge points are within the determined edge lines and a plurality of final edge lines are calculated.

* * * * *